United States Patent [19]

Clipper

[11] Patent Number: 4,512,579

[45] Date of Patent: Apr. 23, 1985

[54] GAME WITH MARBLE AGITATION

[76] Inventor: Eddie L. Clipper, 152 Macon St., Brooklyn, N.Y. 11216

[21] Appl. No.: 600,465

[22] Filed: Apr. 16, 1984

Related U.S. Application Data

[63] Continuation-in-part of Ser. No. 427,552, Sep. 29, 1982, abandoned.

[51] Int. Cl.[3] ..... A63F 7/00

[52] U.S. Cl. ..... 273/123 R; 273/127 B

[58] Field of Search ..... 273/116, 118 A, 118 R, 273/118 D, 119 A, 119 B, 119 R, 123 R, 176 FA

[56] References Cited

U.S. PATENT DOCUMENTS

| | | | |
|---|---|---|---|
| 575,950 | 1/1897 | Hess | 273/123 R |
| 1,274,178 | 7/1918 | McGowan | 273/119 R |
| 1,314,293 | 8/1919 | Wearn | 273/118 R |

FOREIGN PATENT DOCUMENTS

| | | | |
|---|---|---|---|
| 2353246 | 4/1975 | Fed. Rep. of Germany | 273/176 FA |

*Primary Examiner*—Richard C. Pinkham
*Assistant Examiner*—Benjamin Layno

[57] ABSTRACT

A table-top type or handheld game to be played by several players in which marbles are aimed and delivered into cups representing various values or handicaps. The apparatus is skillet shaped and its handle serves as the launching pad for the first marble to be delivered. The handle has a plurality of obstructions. A pan portion has score devices and further handicapping portions. The handle obstructions are in the form of barriers and pockets. The pan portion contains a series of scoring pockets of ascending score values. After a marble lands in one of the score pockets, a marble is then aimed and delivered from the edge of the pan towards a group of balls in the center of the pan. The balls of this group when struck are scattered toward or into various score pockets in the pan. One of the pockets is elevated and has an entrance ramp leading into it. If a ball lands in this elevated pocket, the player is awarded a special marble and with it the player receives a special score.

4 Claims, 4 Drawing Figures

GAME WITH MARBLE AGITATION

This application is a CIP application of my copending application Ser. No. 427,552 filed Sept. 29, 1982, and now abandoned.

FIELD AND BACKGROUND OF THE INVENTION

The present invention relates to a table-top type or hand-held game to be played by several players in which marbles should be aimed and delivered into cups representing various values or handicaps.

SUMMARY OF THE INVENTION

The primary object of the present invention is to provide a challenging game device to each player which offers a chance to master the skill and art of the game similarly as a pool shooter masters the game of pool and at the same time, it provides entertainment to the participants.

BRIEF DESCRIPTION OF THE DRAWINGS

The invention will become more readily apparent from the following description of a preferred embodiment thereof shown, by way of example, in the accompanying drawings, in which.

DESCRIPTION OF THE PREFERRED EMBODIMENT

Figure 1:
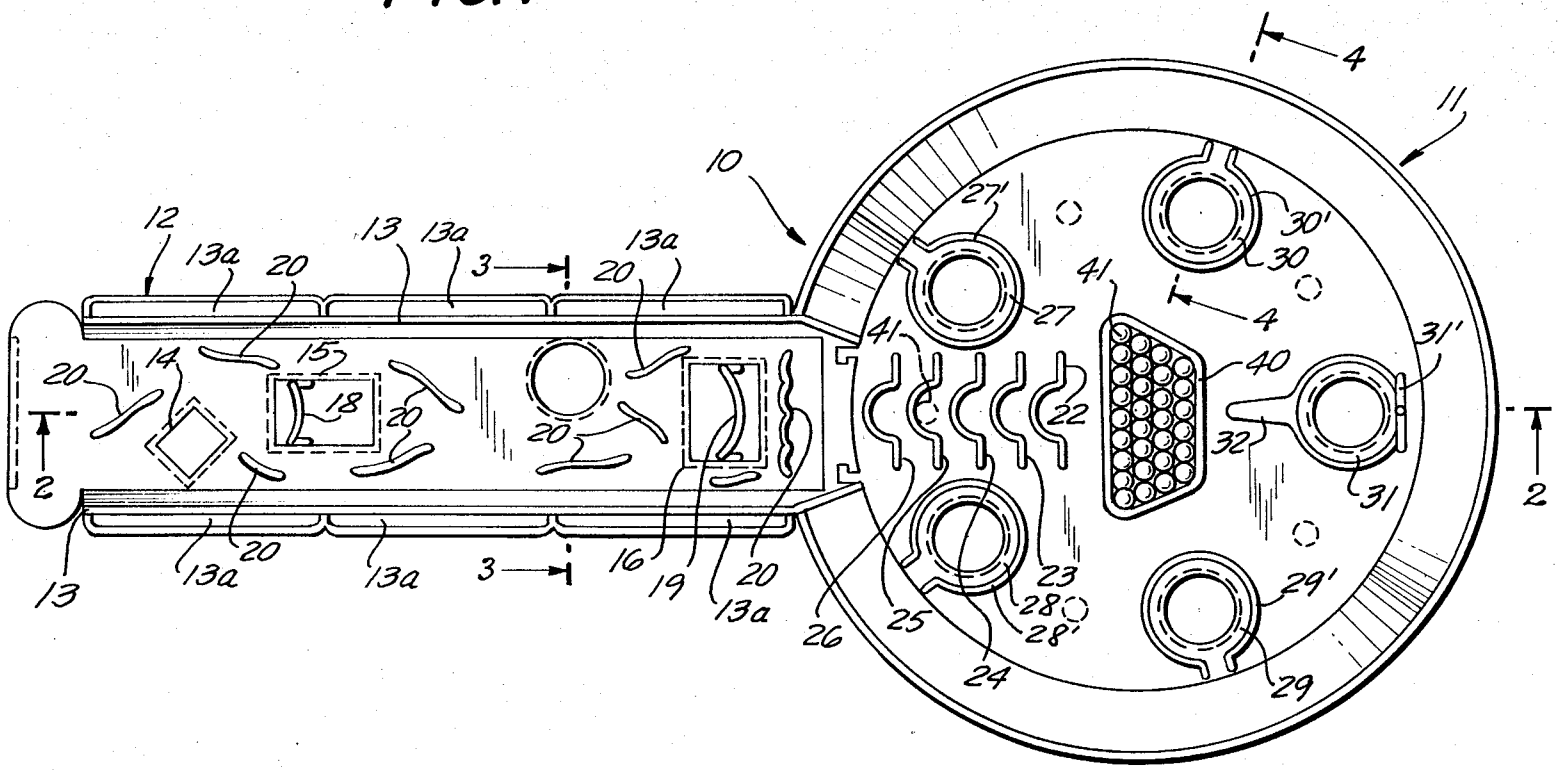
FIG. 1 is a plan view of the game according to the present invention.
Figure 2:
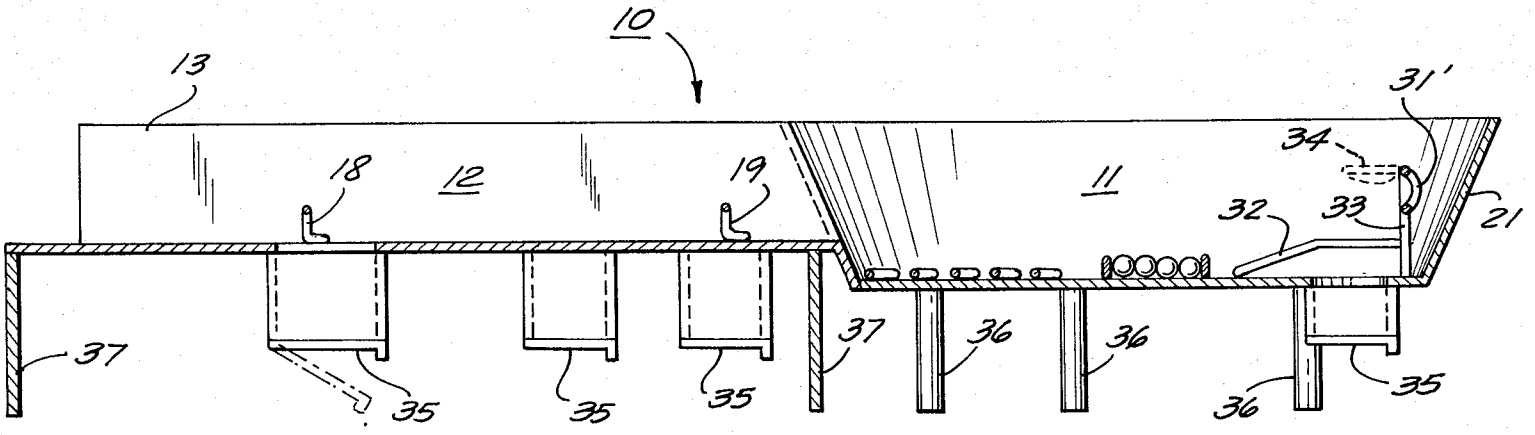
FIG. 2 is a sectional view taken along line line 2—2 of FIG. 1.
Figure 4:
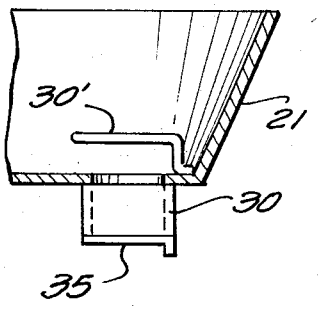
FIG. 4 is a partial sectional view of the skillet portion taken along line 4—4 of FIG. 1.
Figure 3:
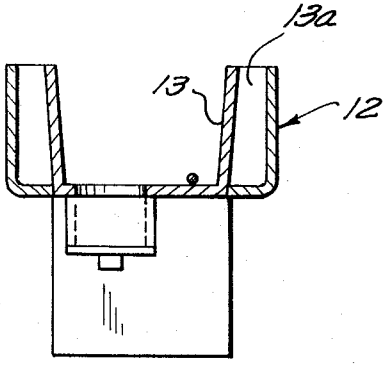
FIG. 3 is a sectional view of the handle portion taken alone line 3—3 of FIG. 1.

With reference to FIG. 1 it is seen that the game apparatus 10 according to the present invention resembles a frying pan or skillet shape device with a particular function for each part of the frying pan, namely, there is the handle portion 12 which serves as the launching or starting area for shooting the marbles and it requires a considerable amount of effort and skill to shoot them into the pan area 11 in which still further skill is necessary to overcome additional obstacles therein.

The marbles are shot from the taw line 1 which is the elongated semi-circular area at the left extremity of the handle portion and such shooting of the marbles is performed in a similar manner as the children shoot marbles. The participants receive a predetermined number of marbles which are stored in packets 13*a* assigned to a particular player according to the color of his marbles and which are formed between the upstanding wall portions 13 of the handle 12. The launching or handle part is an elongated flat area which is covered by a certain number of obstacles 20 which are conventional pipecleaner wires interwoven with yarn laid out on the surface flat area. They serve to deflect the marbles in a manner to prevent them, unless skillfully launched, to reach the pan area 11. To make it more difficult to successfully get the marbles into the pan area 11, there are additional obstacles like 20' and also in the form of boxes 14, 15, 16 and 17 which can be either rectangular or circular and some of them with additional obstacles such as indicated at 18 and 19 over the rectangular boxes. The boxes are provided with snap-off trap doors

35 in order to remove the marbles from them which have been misfired or mislaunched. At the end of the handle portion the additional obstacle 20' is provided to make it more difficult for the players to get the marbles into the pan area. The pan area itself is provided with a flat playing surface and upstanding wall portions 21 to prevent the loss of balls which have been shot with higher velocity and straight into the pan area 11. It is provided with score barriers 22–26 made from the same material as the obstacles 20 and 20' and which are arched in their center portions in the planes of the playing surface in order to catch the marble which happens to enter their area. Such score markers 22–26 and 22' have different values defined between each adjacent score marker in order to assign the priority of further shooting for the participants. The pan area further comprises five cup-shaped receptacles formed in the playing surface of the pan area and indicated by reference characters 27 through 31. Each receptacle is surrounded at the top by a so-called bouncer at a certain height where the receptacle and spaced above the playing surface of the pan area and which are numbered by 27', 28' and 29' and 30. Such bouncers serve to prevent the ball to fly over the walls 21 of the pan area 11 and also to guide the ball down into the associated receptacle. The bouncers can be made from wires in semi-circular or fully circular fashion which have a hole in the middle so that the marble bouncing off from the side wall 21 of the pan 11 still can find its way into the receptacle below. But generally they are placed higher from the bottom of the pan area in order to enable a rolling marble to find its way into the receptacle. The receptacle 31 is assigned special significance in that there is a ramp 32 leading up to its vertical column 33 extends above the receptacle. This column supports a basket 34 capable of holding a marble. The receptacle 31 also has a deflector 31' formed in front of it.

The game itself is a two-part game and in the first part of the game starting from the taw line 1, the highest score is obtained by the player who lands his marble between the score barriers 22–26, in the illustrated embodiment a marble landing between the arched center of barrier 22 and barrier 22', gets the highest score.

The highest scorer player in the second part of the game has the right to shoot at the marbles 41 stacked in the trapezoidal area just like in the billiard game and held in place by a removable frame 40 prior to the shooting at it. The marbles in the stack are contributed by each player and the first shooter is trying to get the marbles into the receptacles 27–31. If the highest scorer player misses, then the next highest scorer takes his turn. The shooting at the stack occurs from a semicircular shooting line but can be done from any place in the pan area where better opportunity exist for getting the highest number of marbles into the receptacle.

A special score is awarded to the player if he is able to shoot a marble up the ramp 32 into receptacle 31. He is awarded a special color, such as a black marble, stored in basket 34. Finally, the marbles are counted by each player and totalled up.

As can be seen from the earlier description a very entertaining game has been provided having an initial obstacle course at the handle portion and additional challenge of shooting the opponent's marbles into the receptacle in the pan area according to the score standing achieved by shooting the marbles from the handle portion into the pan area.

The game apparatus 10 described above is of the portable structure of table model-type and can be fixedly set on the table or on the floor by the legs 36 and 37 for sake of simplicity of carrying, the handle can be made in a detachable form and quickly assembled where the game is to be played.

The invention described above has been made with reference to a particular specific embodiment thereof, however, it will be apparent that various modifications thereof can be implemented without departing from the true spirit and scope of the invention. It is, therefore, intended that the appended claims not be limited to the detailed implementation but cover all such modifications as fall within the spirit and scope of the invention.

I claim:

1. A game apparatus for use with marbles which are shot from a starting line down toward a score line, comprising an elongated launching pad, a plurality of obstacles placed randomly on said pad, a pan portion coupled to said launching pad portion for receiving the marbles shot successfully over said lauching pad portion and a plurality of score marking barriers arranged in a predetermined order in said pan portion for assigning score numbers or priorities for further playing the marbles landing at the various score barriers, wherein said launching pad portion is an elongated handle-shaped member having said plurality of obstacles in the form of a first-type of obstacles for deflecting the marbles into a second plurality of obstacles in the form of receptacles, wherein said pan member comprises a plurality of said score marking barriers arranged in a predetermined order of difficulty and carrying a predetermined number of assigned value according to the difficulty of landing the marbles into said score marking barriers, and further including a plurality of additional score means in the form of a stack of marbles marked for shooting by the highest scoring player into receptacles provided in said pan area, wherein one of said receptacles has an ascending ramp member associated therewith and a basket shaped receptacle formed at a predetermined height above said ramp and containing a special marble awarded to the player for a marble shot up the ramp and into the associated receptacle.

2. The game apparatus as claimed in claim 1, wherein said launching pad member and said pan member have upstanding wall portions for preventing of losing marbles during the shooting.

3. The game apparatus as claimed in claim 1, comprising a flat bottom for a table-model type apparatus.

4. The game apparatus as claimed in claim 1, comprising a plurality of legs.

* * * * *